United States Patent [19]

Suzuki

[11] Patent Number: 4,509,188

[45] Date of Patent: Apr. 2, 1985

[54] SIGNAL SYNTHESIZER APPARATUS

[75] Inventor: Seigo Suzuki, Tokyo, Japan

[73] Assignee: Tokyo Shibaura Denki Kabushiki Kaisha, Japan

[21] Appl. No.: 504,747

[22] Filed: Jun. 16, 1983

Related U.S. Application Data

[63] Continuation of Ser. No. 259,207, Mar. 30, 1981, Pat. No. 4,403,295.

[30] Foreign Application Priority Data

Apr. 3, 1980 [JP] Japan ..... 55-43868

[51] Int. Cl.[3] ..... G10L 1/00

[52] U.S. Cl. ..... 381/53

[58] Field of Search ..... 381/53, 40, 51, 52; 364/513, 844, 862; 307/221 D

[56] References Cited

U.S. PATENT DOCUMENTS

| | | | |
|---|---|---|---|
| 3,662,115 | 5/1972 | Saito et al. | 381/40 |
| 4,110,835 | 8/1978 | Dubil et al. | 364/844 |
| 4,126,852 | 11/1978 | Baertsch | 340/347 DA |
| 4,161,785 | 7/1979 | Gasparek | 364/844 |

OTHER PUBLICATIONS

Kang, "Linear Predictive Narrowband Voice Digitizer", Report NRL Progress, May 1974, pp. 9–72.

Albarron et al., "A Charge Transfer Multiplying Digital to Analog Converter", IEEE J. Solid State, Dec. 1976, pp. 772–779.

Strube, "Analog Discrete Time Filter", IEEE Trans. on Acoustics, etc., Feb. 1977, pp. 50–54.

*Primary Examiner*—E. S. Matt Kemeny

*Attorney, Agent, or Firm*—Finnegan, Henderson, Farabow, Garrett & Dunner

[57] ABSTRACT

A signal synthesizer apparatus having a parameter dependent multiplier which includes charge-coupled devices. The multiplier has a gating input to store a charge corresponding to an input signal applied thereto; a transmission circuit for selectively transferring portions of the stored input charge, the selectivity of the transmission circuit being dependent on the prescribed parameter; and an output for receiving and combining all of the charges transferred from the transmission circuit. The transmission circuit comprises a first circuit for selectively dividing the charge corresponding to the input signal into given fragments and for transferring the divided charge, and a second circuit for determining the selectivity of the dividing of the charge according to the prescribed parameter. The rate of the dividing of charge corresponds to the multiplicative coefficient of the multiplier.

2 Claims, 15 Drawing Figures

SIGNAL SYNTHESIZER APPARATUS

This is a continuation of application Ser. No. 259,207, filed Mar. 30, 1981 and issued Sept. 6, 1983 as U.S. Pat. No. 4,403,295.

The present invention relates to a signal synthesizer apparatus suitable for synthesizing analog signals such as voice signals.

Active development and practice of apparatus for synthesizing voice signals prevails these days. There are various systems of synthesizing voice signals and they can be generally grouped into either a waveform coding scheme or a parameter scheme. Apparatus of the waveform coding scheme have merit in that the circuit arrangement is simple but a disadvantage in that the degree of compression is not large. On the other hand, apparatus of the parameter scheme have a complicated circuit arrangement, but enable the compression degree to be made extremely large.

FIG. 1 is a block diagram showing a conventional voice synthesizing circuit of a linear predictive coding scheme which is one of the parameter schemes. The one similar to this voice synthesizing circuit is disclosed in a publication "IEEE TRANSACTIONS ON ACOUSTICS, SPEECH, AND SIGNAL PROCESSING", VOL. ASSP-27, No. 6, DECEMBER 1979. In FIG. 1, an electronic switch 11 is intended to switch a white noise generator 12 and an inpulse train generator 13. Impulse signals are used as a signal source to synthesize vocal sounds (vowels and vocal consonants) such as a, u, m and b, and white noises as a signal source to synthesize voiceless consonants such as p, t and f. These white noises and impulse signals may be regarded as a kind of analog signal. White noise and impulse signals are appropriately amplified by an amplifier 14 and then converted by an analog-to-digital converter 15 to a digital signal. The converted digital signal is applied to a time varying digital filter circuit 16 which is the so-called voice filter. The signal passed through the filter circuit 16 is again converted by a digital-to-analog converter 17 to an analog signal, whereby a desired voice signal or a speech output is gained.

FIG. 2A shows an arrangement of filter circuit 16 shown in FIG. 1. The filter circuit 16 is formed of cascade-connected n-stage lattice type filters $\mathbf{16}_1$–$\mathbf{16}_n$.

FIG. 2B shows a part of filter circuit 16 in which a filter of one stage, $\mathbf{16}_{n-1}$ comprises digital signal composer circuits 21, 22 having adding and subtracting functions, digital multiplier circuits 23, 24 and a digital signal delay circuit 25. These filters are cascade-connected with one another in eight or twelve stages to form 8- or 12-stage digital filters of full-pole type.

Various voice signals are obtained through this circuit arrangement by changing the signal changeover time of switch 11, that is, the sampling time and parameters K for the filter circuit 16.

Digital multiplier circuits 23 and 24 employed in the filter circuit 16 must process an extremely large amount of data in a short time period, and it is therefore necessary that they achieve high speed operation. In addition, they have an extremely complicated circuit arrangement, so that chip size becomes extremely large upon integration of the circuits, thereby making the cost high. Further, the conventional filter is a digital one, thus making it necessary to include analog-to-digital converter 15 for converting an analog signal applied from the switch 11 to a digital signal, and digital-to-analog converter 17 for converting a digital signal applied from the filter circuit 16 to an analog signal. This is one cause which makes chip size large upon circuit integration of a voice signal synthesizer.

The present invention is intended to eliminate the above-mentioned drawbacks, and the object of the present invention is to provide a signal synthesizer apparatus in which chips can be easily kept small in size upon circuit integration thereof and no A/D and D/A converters are needed.

For the purpose of achieving the object of the present invention, the signal synthesizer apparatus according to the present invention includes a parameter dependent multiplier in the time varying filter thereof, said multiplier comprising a charge transfer device such as a charge-coupled device (CCD) or a bucket brigade device (BBD). More particularly, the signal synthesizer apparatus includes a parameter dependent multiplier, the parameter dependent multiplier comprising input means for storing an input signal as an input charge, transmission means coupled to the input means for selectively transfering charges of the input charge, the selectivity of transmission means being dependent on a prescribed parameter, an intermediate means for storing charges transferred from the transmission means, and output means coupled to the intermediate means for combining charges stored by the intermediate means so as to provide an output signal.

The signal synthesizer thus arranged needs neither digital multplier circuits whose arrangement is complicated nor AD/DA converters as the conventional digital type synthesizer does, and can use MOS IC manufacturing techniques already established. Accordingly, the synthesizer according to the present invention enables desired chips to be small-sized upon circuit integration thereof and mass production to be carried out with low cost.

This invention can be more fully understood from the following detailed description when taken in conjunction with the accompanying drawings, in which.

Before proceeding with the description of embodiments of the invention, it will expressly be understood that like reference symbols are used to designate like portions throughout the drawings for simplicity of illustration and that components designated by like reference symbols may easily be replaced with each other or one another with minor change thereof by a person of ordinary skill in the art. An embodiment of signal synthesizer according to the invention will be described with reference to drawings.

Figure 1:
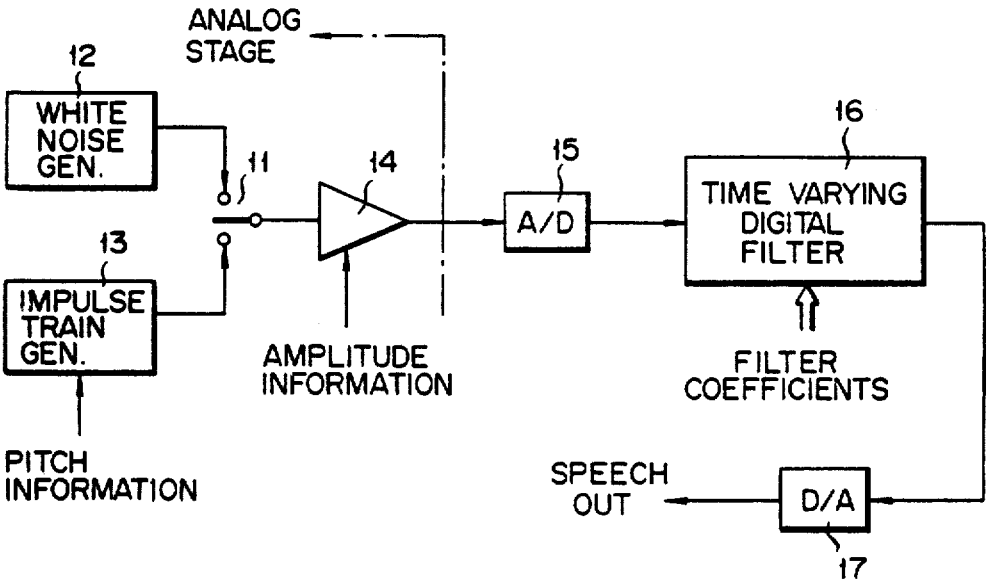
FIG. 1 PRIOR ART
FIG. 1 shows a block configuration of prior art voice signal synthesizer.
Figure 2A:
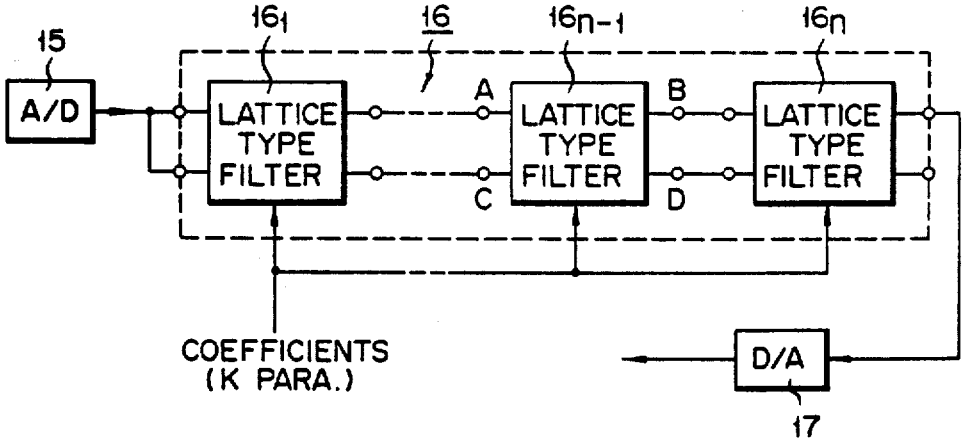
FIG. 2A PRIOR ART
FIG. 2A is a block diagram illustrating a construction of time varying digital filter shown in FIG. 1.
Figure 2B:
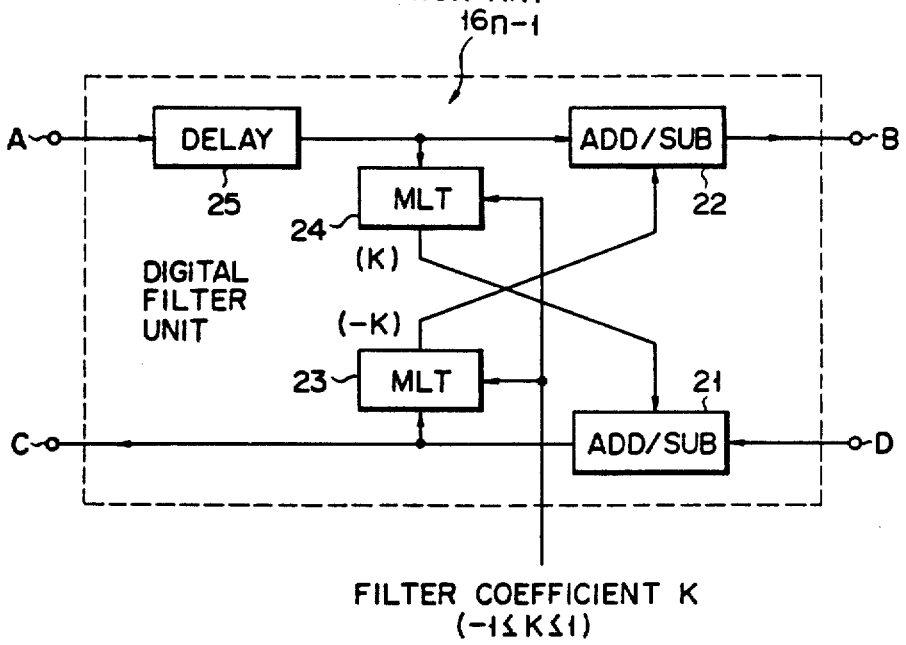
FIG. 2B PRIOR ART
FIG. 2B is a block diagram showing in detail the construction of lattice type filter shown in FIG. 2A.
Figure 3:
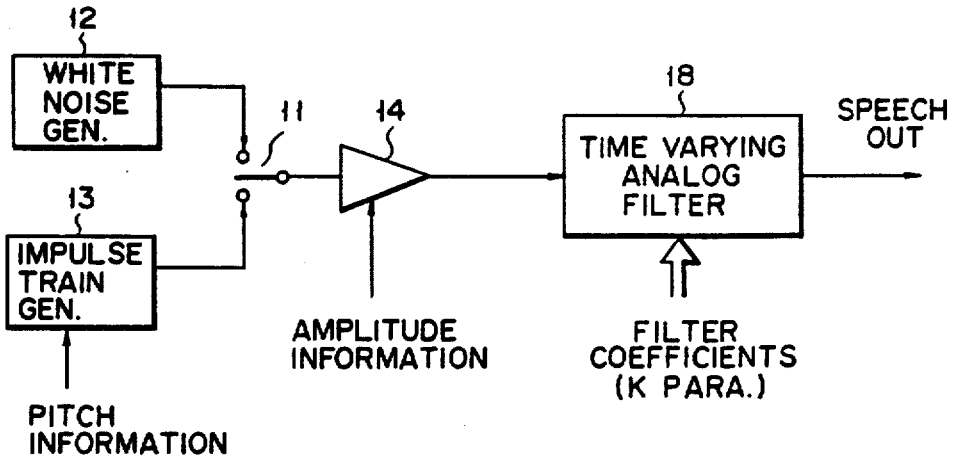
FIG. 3 is a block diagram showing a typical one of voice signal synthesizer according to the present invention.
Figure 4:
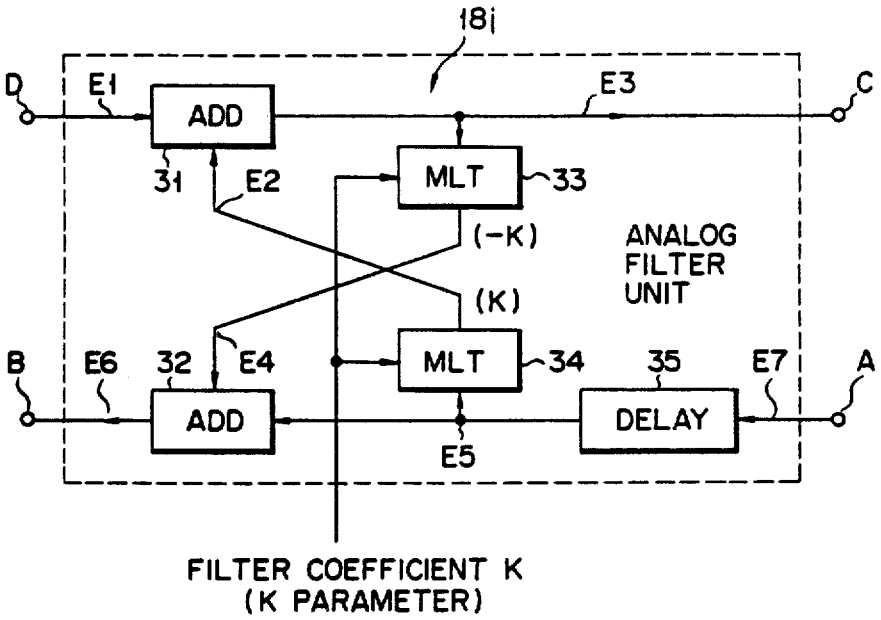
FIG. 4 is a block diagram showing a construction of lattice type filter unit employed in the synthesizer of FIG. 3.

FIG. 3 is a block diagram showing an embodiment of a signal synthesizer circuit according to the invention. This circuit embodiment is different from conventional ones in that the time varying digital filter circuit 16 which is the so-called voice filter is replaced by a time varying analog filter circuit 18 in which a CCD is employed. Therefore, analog-to-digital converter 15 and digital-to-analog converter 17 are made unnecessary and omitted. One stage filter $\mathbf{18}_i$ of filter circuit 18 is formed as shown in FIG. 4, in which numerals 31 and 32 represent analog signal adder circuits which function to add together analog signals, 33 and 34 analog signal attenuator circuits or multipliers, and 35 an analog signal delay circuit. Each of these circuits is formed of a charge transfer device such as CCD (charge coupled device) or a BBD (bucket brigade device). Single stage filters $\mathbf{18}_i$ as described above are cascade-connected in, e.g., eight or twelve stages similar to the conventional manner to form an analog filter of full-pole type.

This circuit arrangement allows high speed operation to be attained similar to prior art ones and makes it unnecessary to use digital multplier circuits which are complicated in circuit arrangement. Therefore, chips can be easily small-sized upon integration of the circuits. In addition, filter circuit 18 of an analog type is used, so that conventional AD and DA converters are made unnecessary, thus making the arrangement of the filter itself simple and the chips small-sized.

Figure 5A:
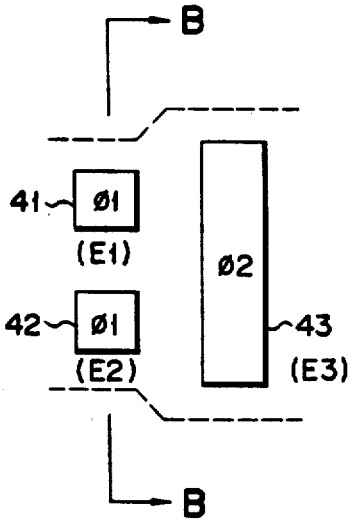
FIGS. 5A and 5B show a brief construction of analog signal or adder shown in FIG. 4.
Figure 5B:
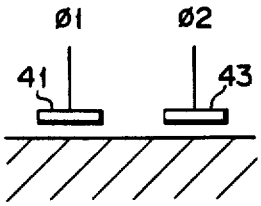

FIGS. 5A and 5B show an example of analog signal adder circuit 31 or 32 including the CCD, in which FIG. 5A is a plane view thereof and FIG. 5B a sectional view thereof. It is assumed that analog signals E1 and E2 having charges Q1 and Q2 are respectively applied to transfer gates 41 and 42 which are controlled by a clock signal $\phi$1. When a clock signal $\phi$2 is applied under this condition to a transfer gate 43 adjacent to the gates 41 and 42, both of signals E1 and E2 are transferred to the gate 43 and addition of $Q1+Q2^-$ is carried out to gain a signal E3.

Figure 6:
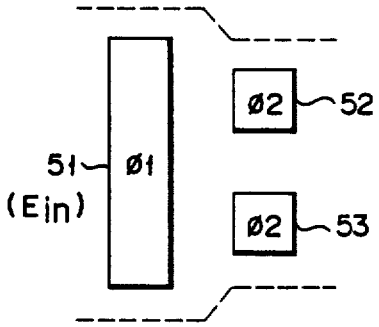
FIG. 6 shows a brief construction of analog signal attenuator or parameter dependent multiplier shown in FIG. 4.

FIG. 6 is a plane view showing an example of analog signal attenuator or parameter dependent multiplier 33 (or 34) in which the CCD is employed. Since the absolute value of a parameter K is smaller than 1 in the analog attenuator circuit 33 or 34, a case where the parameter K is 0.5 is shown here. It is assumed that an analog signal Ein having a charge Qin is applied to a transfer gate 51 which is controlled by a clock signal $\phi$1 and that a clock signal $\phi$2 is applied under this condition to transfer gates 52 and 53 adjacent to the gate 51. The charge Qin of analog signal Ein is divided by two and a charge of Qin/2 is stored in each of transfer gates 52 and 53, respectively. Thereafter, one of the charges stored in the two transfer gates 52 and 53 is picked out as an output to achieve attenuation of ½. Namely, FIG. 6 shows an analog multiplier whose multiplying number is 0.5.

Figure 7:
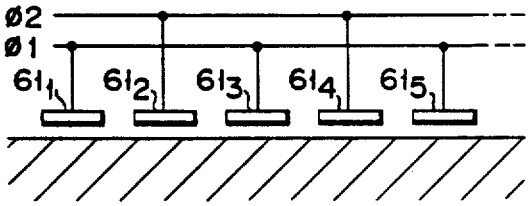
FIG. 7 shows a brief construction of CCD type analog signal delay circuit shown in FIG. 4.

FIG. 7 is a sectional view showing an example of analog signal delay circuit 35. When a signal charge is applied to a transfer gate $\mathbf{61}_1$ positioned in the most left-hand side, the signal charge is thereafter transferred to right-hand-side transfer gates $\mathbf{61}_2$, $\mathbf{61}_3$, . . . , successively, responsive to clock signals $\phi$1 and $\phi$2. The signal delay time thus attained is proportional to the number of transfer gates through which the signal charge is transferred, and inversely proportional to the frequency of signals $\phi$1 and $\phi$2.

According to the invention, the filter circuit is formed of analog signal adder circuits, analog multiplier circuits and an analog signal delay circuit, each of which employs the charge transfer device, thus allowing chips to be small-sized upon the integration of circuits and cost to be lowered.

Figure 8:
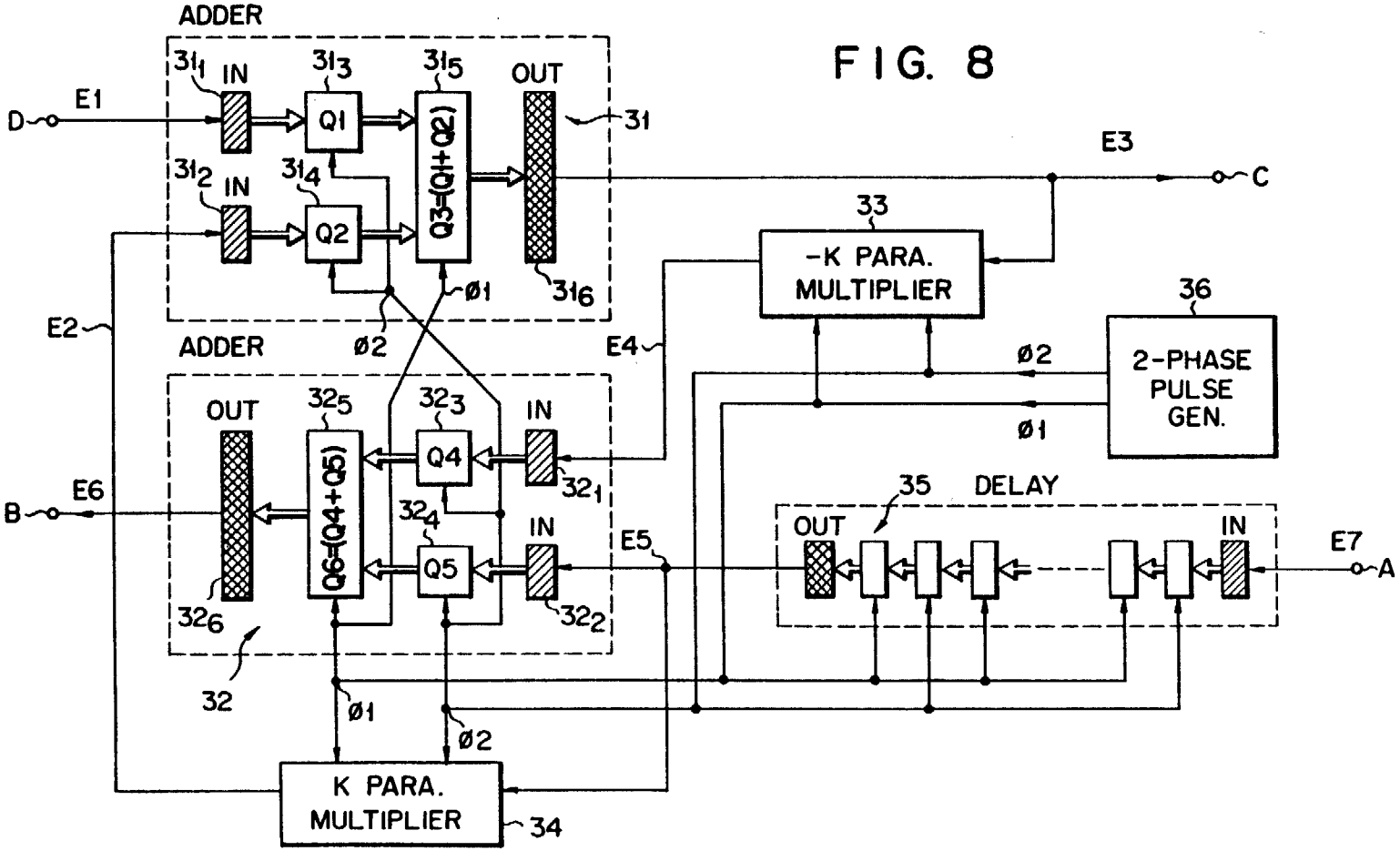
FIG. 8 is a block diagram showing in detail a construction of lattice type filter shown in FIG. 4.

FIG. 8 shows a detailed arrangement of lattice type filter $\mathbf{18}_i$ shown in FIG. 4. A signal E1 is applied through the terminal D to a first gating input $\mathbf{31}_1$ of a first adder 31. Applied to a second gating input $\mathbf{31}_2$ of adder 31 is a signal E2 from a multiplier 34 which will be described later. When a clock pulse $\phi$2 is applied to electrodes $\mathbf{31}_3$ and $\mathbf{31}_4$, a charge Q1 corresponding to the potential of sigal E1 applied to the input $\mathbf{31}_1$ is transferred to the elecrode $\mathbf{31}_3$ and a charge Q2 corresponding to the potential of signal E2 applied to the input $\mathbf{31}_2$ to the electrode $\mathbf{31}_4$. When a clock pulse $\phi$1 is then applied to an electrode $\mathbf{31}_5$, charges Q1 and Q2 are transfered to the electrode $\mathbf{31}_5$. If the charge transfer is attained with an efficiency of 100 percent, a charge Q3 transferred to the electrode $\mathbf{31}_5$ is equal to Q1+Q2. Even if the efficiency is less than 100 percent, the charge Q3 accurately corresponds to the sum (Q1+Q2) of charges. The charge Q3 is picked out as a signal E3 through an output $\mathbf{31}_6$. The signal E3 is applied to the termial C.

The adder 31 or components $\mathbf{31}_1$ to $\mathbf{31}_6$ have the CCD structure of conventional 2-phase type. Clock pulses $\phi$1 and $\phi$2 can also be obtained from a conventional 2-phase clock pulse generator 36.

The signal E3 is converted by a multiplier 33 to a signal E4. The multiplier 33 multiplies the signal E3 by a given parameter $-K$ ($|K| \leqq 1$) to produce $E4=-KE3$.

The signal E4 is applied to a first gating input $\mathbf{32}_1$ of a second adder 32. Applied to a second gating input $\mathbf{32}_2$ is a signal E5. The signal E5 corresponds to a signal E7 applied to the terminal A, that is, to a signal picked out after the signal E7 is delayed by a given time period. The delay of signal E7 is carried out using a conventional CCD delay circuit 35. The CCD of 2-phase type is employed here, but another phase type or analog delay line of other type may be used. A charge Q4 corresponding to the potential of signal E4 and a charge Q5 corresponding to the potential of signal E5 are transferred to electrodes $\mathbf{32}_3$ and $\mathbf{32}_4$ responsive to the clock pulse $\phi$2. Charges Q4 and Q5 are then transferred to an electrode $\mathbf{32}_5^-$ responsive to the occurrence of clock pulse $\phi$1. A charge Q6 transferred to the electrode $\mathbf{32}_5$ corresponds to Q4+Q5. The charge Q6 is picked out as a signal E6 from the terminal B through an output $\mathbf{32}_6$.

The signal E5 is converted through the already-described multiplier 34 to the signal E2. The multiplier 34 multiplies the signal E5 by a given parameter K ($|K| \leqq 1$) to produce E2=KE5.

Figure 9:
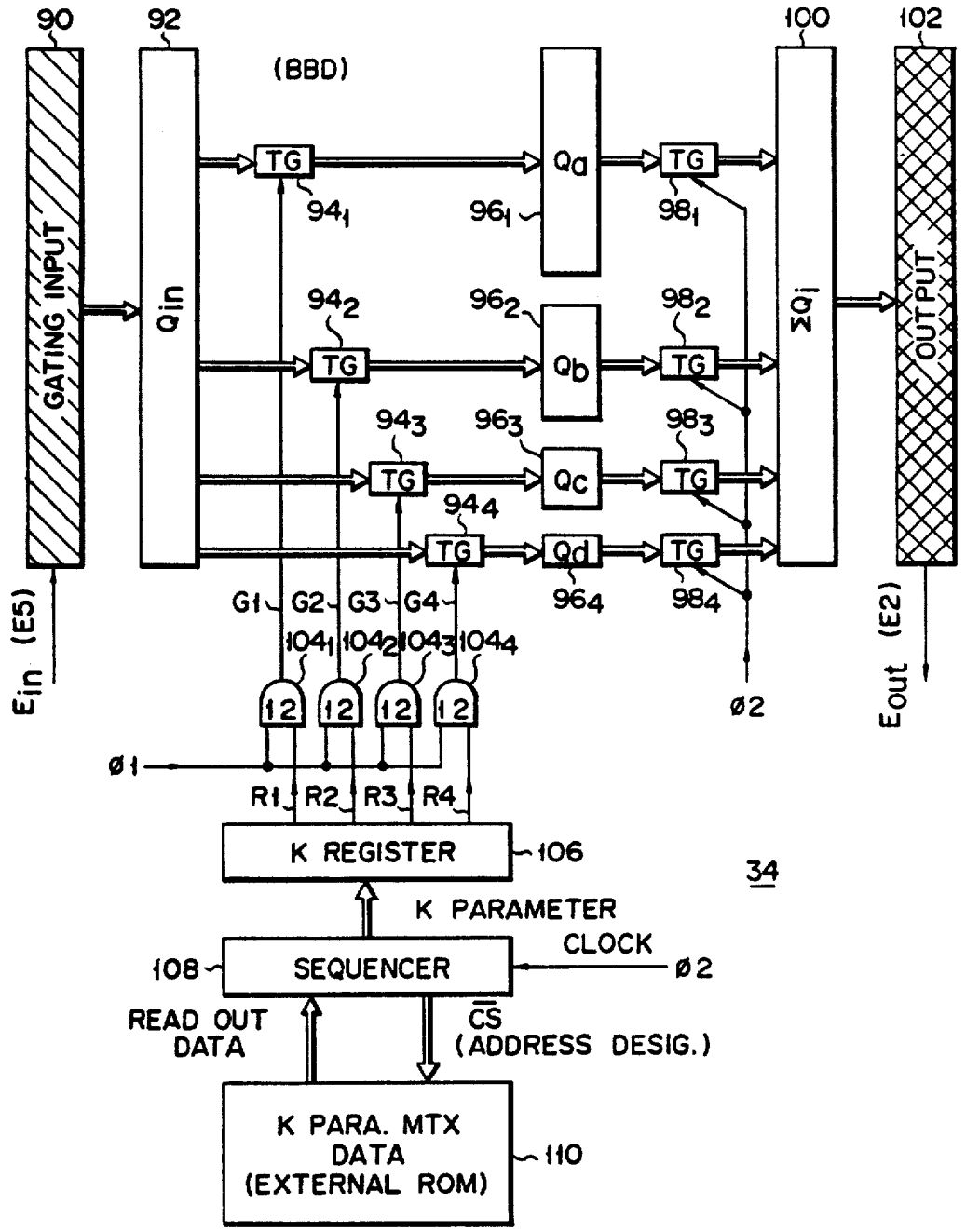
FIG. 9 is a circuit diagram showing in detail a construction of parameter dependent multplier shown in FIG. 4 or 8.

FIG. 9 shows in detail the parameter dependent multiplier 34 shown in FIG. 8. An input signal Ein (or the signal E5) is applied to a gating input 90. A charge Qin corresponding to the potential of signal Ein is stored in an input electrode 92. The electrode 92 is coupled via transmission gates $94_1$, $94_2$, $94_3$ and $94_4$ to electrodes $96_1$, $96_2$, $96_3$ and $96_4$, respectively. Electrodes $96_1$ to $96_4$ are connected via transmission gates $98_1$ to $98_4$ to an output electrode 100. A charge Σ Qi (i=a, b, c, d) is picked out as an output signal Eout (or the signal E2) through an output 102.

Gate inputs G1 to G4 of transmission gates $94_1$ to $94_4$ are obtained from outputs of AND gates $104_1$ to $104_4$. The clock pulse $\phi 1$ is applied to first inputs of gates $104_1$ to $104_4$, whose second inputs are connected to a 4-bit register 106. Gates $104_1$ to $104_4$ transmit contents R1 to R4 of register 106 to transmission gates $94_1$ to $94_4$ when the pulse $\phi 1$ becomes logic "1". When R1, R2, R3, R4=0101 and the pulse $\phi 1$ is at logic "1", for example, gates $104_2$ and $104_4$ are made open. Accordingly, outputs G1, G2, G3, G4 of gates $104_1$ to $104_4$ become equal to 0101 to make only gates $94_2$ and $94_4$ open. A portion of charge Qin is transferred to electrodes $96_2$ and $96_4$ in this case. The charge Qin is divided at a given rate when transferred to electrodes $96_1$ to $96_4$, and it will be described later with reference to FIG. 13.

Contents of register 106 are determined by a sequencer 108, which may have the same arrangement as that of model Am2909 made by Advanced Micro Devices Inc., USA, for example. The sequencer 108 supplied address designation data $\overline{CS}$ to an external ROM 110. Stored in the ROM 110 are data representing given K parameters. For example, if data $\overline{CS}$ designates the 100th address, data $K_{100}$ stored in the 100th address of ROM 110 is read through the sequencer 108. When the data $K_{100}$ is loaded in the register 106, either of transmission gates $94_1$ to $94_4$ corresponding to the data $K_{100}$ is made through upon the occurrence of pulse $\phi 1$. When the pulse $\phi 2$ is then incremented by one, a sequence counter in the sequencer 108 is incremented by "1", thus causing data $\overline{CS}$ to designate the 101th address. K parameter in the 101th address is loaded at this time in the register 106. The sequencer 108 thus determines the conduction state of a gating matrix or a K parameter matrix formed by transmission gates $94_1$ to $94_4$. The K parameter changes every moment responsive to the clock pulse $\phi 2$ applied to the sequencer 108.

Figure 12:
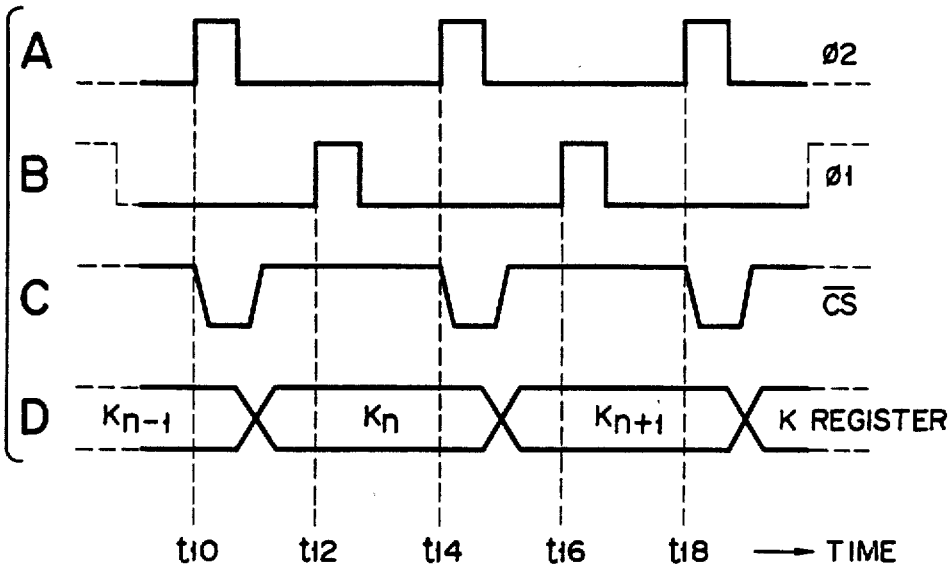
FIG. 12 is a timing chart illustrating the operation of multiplier shown in FIG. 9.

FIG. 12 shows a sequence of above-described operation. The K parameter is determined by contents $K_{n-1}$ in the (n−1)th address of ROM 110 before a time t10 (FIG. 12D). When the pulse $\phi 2$ becomes logic "1" at the time t10 (FIG. 12A), data $\overline{CS}$ designates n-th address and the K parameter becomes contents $K_n$ in the n-th address (FIG. 12D). When the pulse $\phi 1$ becomes logic "1" at a time t12 (FIG. 12B), transmission gates $94_1$ to $94_4$ corresponding to contents $K_n$ are made through. When the pulse $\phi 2$ becomes logic "1" at a time t14 (FIG. 12A), all of transmission gates $98_1$ to $98_4$ are made through, causing charges Qa to Qd of electrodes $96_1$ to $96_4$ to be transferred to the electrode 100. After the time t14, the same operation is carried out as that achieved after the time t10. Namely, transmission gates $94_1$ to $94_4$ corresponding to contents $K_{n+1}$ are made through at a time t16 and transmission gates $98_1$ to $98_4$ are made through at a time t18.

The multiplier K, i.e. K=Eout/Ein=Σ Q1/Qin, of multiplier 34 shown in FIG. 9 varies depending upon contents R1 to R4 of register 106. It is assumed that the capacitance of electrode 92 is Cin, that capacitances of electrodes $96_1$, $96_2$, $96_3$ and $96_4$ are Ca, Cb, Cc and Cd, respectively, and that electrodes 92 and $96_1$ to $96_4$ are arranged to establish Cin=2Ca=4Cb=8Cc=16Cd (ratios of Ca to Cd relative to Cin and the number of electrodes 96 can be determined optionally).

Figure 13:
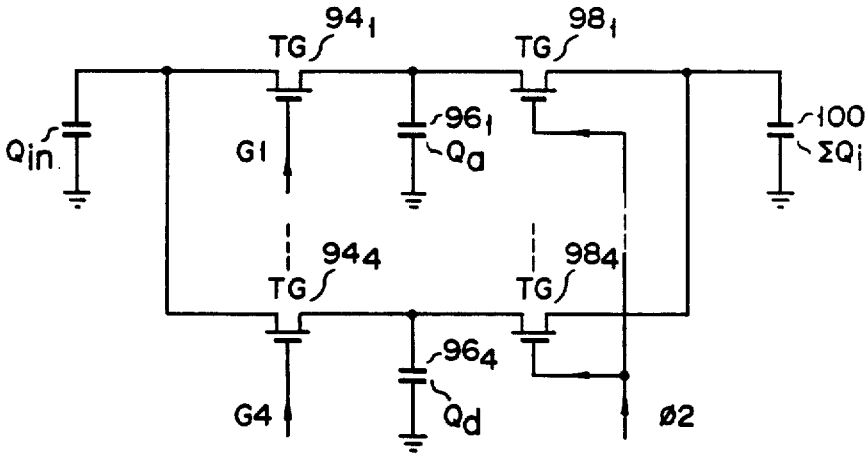
FIG. 13 shows an equivalent circuit of charge transferring portion of multiplier shown in FIG. 9.

FIG. 13 is now referred to under the assumption considering a case where contents R1 to R4 of register 106 is 1001. Only transistors $94_1$ and $94_4$ of MOS transistors forming transmission gates $94_1$ to $94_4$ are rendered conductive at first. In this case, a charge Qa corresponding to Qin/2 is transferred to the electrode $96_1$ and a charge Qd corresponding to Qin/16 is transferred to the electrode $96_4$. And when all of MOS transistors forming transmission gates $98_1$ to $98_4$ are then made conductive, a charge Σ Qi having such magnitude as corresponds to Qin/2+Qin/16=(9/16) Qin is transferred to the electrode 100. As apparent from the above description, the magnitude of Σ Qin varies depending upon contents of register 106. In other words, the multiplier K of multiplier 34 varies responsive to the repeat of clock pulse $\phi 2$ according to data stored in the ROM 110.

Figure 10:
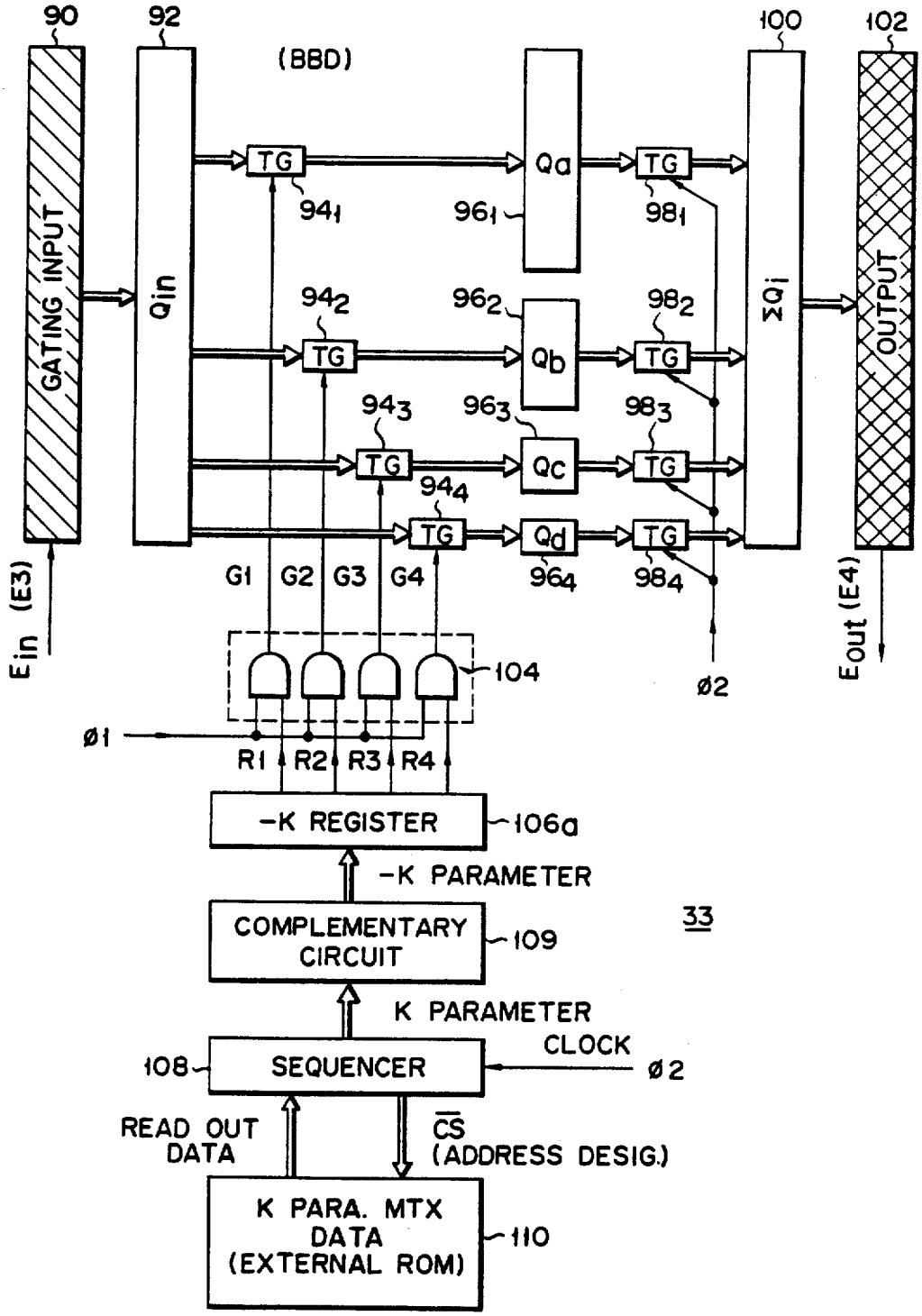
FIG. 10 is a circuit diagram showing in detail a construction of another parameter dependent multiplier shown in FIG. 4 or 8.

FIG. 10 shows in detail the parameter dependent multiplier 33 shown in FIG. 8. The multiplier shown in FIG. 10 has the same arrangement as that of multiplier shown in FIG. 9. +K ($K \leqq 1$) is used as the multiplier in FIG. 9 and −K in FIG. 10. An inverter array or complementary circuit 109 of 4-bit is arranged between the sequencer 108 and a register 106*a* to produce −K. Namely, a complemental relation is established between the contents of register 106 shown in FIG. 9 and those of register 106*a* shown in FIG. 10.

Figure 11:
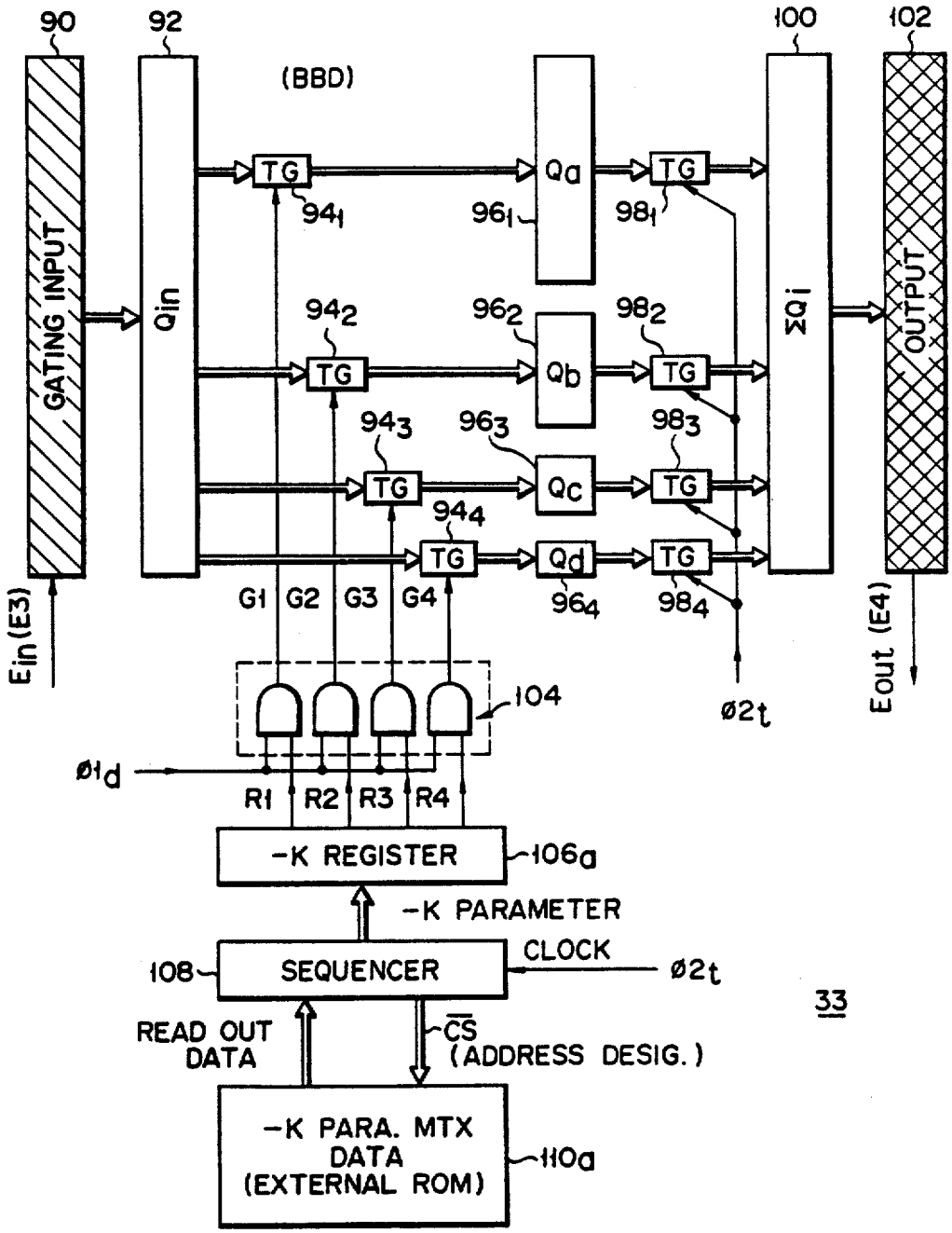
FIG. 11 is a circuit diagram showing a modification of multiplier shown in FIG. 10.

FIG. 11 shows a modification of multiplier shown in FIG. 10. No complementary circuit is used in the multiplier shown in FIG. 11, but data corresponding to −K is stored instead in a ROM 110*a* itself.

Although specific constructions have been illustrated and described herein, it is not intended that the invention be limited to the element and construction disclosed. One skilled in the art will recognize that other particular elements or subconstruction may be used without departing from the scope and spirit of the invention. The present invention can be applied to voice synthesizing apparatus of another type such as that of a linear predictive coding scheme. Further, the parameter dependent multiplier (attenuator) as shown in FIG. 9 can be applied to analog equipments as well as voice synthesizers.

When the construction of FIG. 9 further includes an inverter connected in series with the signal path, such construction may be used for the −K parameter dependent multiplier 33.

What is claimed is:

1. A signal synthesizer apparatus including a parameter dependent multiplier utilizing a charge transfer device whose multiplicative coefficient is determined by a prescribed parameter, said signal synthesizer apparatus comprising:

input means including an input electrode for storing an input charge corresponding to an input signal applied to said parameter dependent multiplier;

transmission means coupled to said input means for selectively transferring charges of said input charge, the selectivity of said transmission means being dependent on said prescribed parameter; and output means for receiving charges transferred from said transmission means and providing an output signal corresponding to the received charges, wherein said input charge represents only said input signal, and said transmission means comprises:

charge divide means located in a charge-transferring path between said input means and said output means for selectively dividing said input charge into given fragments and transferring the divided fragments of charge to said output means, said charge divide means includes a plurality of transfer electrodes, each of said transfer electrodes stores a part of the given fragments of said input charge and has a given capacitance less than the capacitance of said input electrode, said given fragments of said input charge being obtained by charge-dividing according to the ratio of the given capacitance of each of said transfer electrodes to the capacitance of said input electrode; and determination means coupled to said charge divide means for determining the selectivity of the dividing of charge according to said prescribed parameter, with the rate of the dividing of charge corresponding to said multiplicative coefficient, said determination means including a plurality of first transmission switches coupled respectively to said transfer electrodes for enabling operation of said transfer electrodes, and designation means coupled to said first transmission switches for designating which one of said first transmission switches enables operation of a corresponding one of said transfer electrodes.

2. A signal synthesizer apparatus including a parameter dependent multiplier utilizing a charge transfer device whose multiplicative coefficient is determined by a prescribed parameter, said signal synthesizer apparatus comprising:

input means including an input electrode for storing an input charge corresponding to an input signal applied to said parameter dependent multiplier;

transmission means coupled to said input means for selectively transferring charges of said input charge, the selectivity of said transmission means being dependent on said prescribed parameter; and output means for receiving charges transferred from said transmission means and providing an output signal corresponding to the received charges, wherein said input charge represents only said input signal, and said transmission means comprises:

charge divide means located in a charge-transferring path between said input means and said output means for selectively dividing said input charge into given fragments and transferring the divided fragments of charge to said output means, said charge divide means includes a plurality of transfer electrodes, each of said transfer electrodes stores a part of the given fragments of said input charge and has a given capacitance less than the capacitance of said input electrode, said given fragments of said input charge being obtained by charge-dividing according to the ratio of the given capacitance of each of said transfer electrodes to the capacitance of said input electrode; and determination means coupled to said charge divide means for determining the selectivity of the dividing of charge according to said prescribed parameter, with the rate of the dividing of charge corresponding to said multiplicative coefficient, said determination means including a plurality of first transmission switches coupled respectively to said transfer electrodes for enabling operation of said transfer electrodes, and designation means coupled to said first transmission switches for designating which one of said first transmission switches enables operation of a corresponding one of said transfer electrodes, said designation means includes parameter means for generating data representing said prescribed parameters, and switch control means coupled to said parameter means and to said first transmission switches for controlling the conduction state of said first transmission switches according to the data generated by said parameter means.

* * * * *

UNITED STATES PATENT AND TRADEMARK OFFICE

CERTIFICATE OF CORRECTION

PATENT NO. : 4,509,188

DATED : April 2, 1985

INVENTOR(S) : Seigo Suzuki

It is certified that error appears in the above—identified patent and that said Letters Patent is hereby corrected as shown below:

Please change the front page of the patent to read as follows:

[63] Continuation of Ser. No. 249,207, Mar. 30, 1981, Pat. No. 4,403,295

Signed and Sealed this

*Eighteenth* Day of *February 1986*

[SEAL]

*Attest:*

DONALD J. QUIGG

*Attesting Officer*

*Commissioner of Patents and Trademarks*